US005271995A

United States Patent [19]

Paley et al.

[11] Patent Number: 5,271,995

[45] Date of Patent: Dec. 21, 1993

[54] PARTICULATE CONTAMINATION CONTROL IN CLEANROOMS

[75] Inventors: Edward Paley, Saddle River; Steven J. Paley, Paramus, both of N.J.; Charles F. Mattina, Lenox, Mass.

[73] Assignee: The Texwipe Company, Upper Saddle River, N.J.

[21] Appl. No.: 483,662

[22] Filed: Feb. 23, 1990

[51] Int. Cl.[5] ..... D03D 3/00

[52] U.S. Cl. ..... 428/224; 15/209.1; 15/210.1; 428/225; 428/253; 428/913

[58] Field of Search ..... 428/224, 253, 913, 225; 15/209 R

[56] References Cited

U.S. PATENT DOCUMENTS 4,482,594 11/1984 Stousland ..... 428/96

4,888,229 12/1989 Paley et al. ..... 428/224

*Primary Examiner*—James J. Bell

*Attorney, Agent, or Firm*—Samuelson & Jacob

[57] ABSTRACT

An article of manufacture, such as a wiper, especially suited for use in a controlled environment, such as a cleanroom environment, and a method for controlling the entry of deleterious particles into the controlled environment, within which environment a process is carried out, the article being constructed of fibers of a synthetic polymeric material of the type including only constituents which are relatively benign in that the included constituents will be less likely to have a deleterious effect upon the process carried out in the controlled environment or upon the product of that process, the method including constructing the article of such fibers, the preferred synthetic polymeric materials including no more than only negligible amounts of inorganic constituents or metallic constituents, one such preferred synthetic polymeric material being nylon bright.

3 Claims, No Drawings

PARTICULATE CONTAMINATION CONTROL IN CLEANROOMS

The present invention relates generally to the prevention of certain particulate contamination in cleanrooms and pertains, more specifically, to the construction of articles of manufacture, such as wipers and other textile articles, and a method for use in a cleanroom, or another similar controlled environment, the construction and method being such that the articles will not release unwanted, contaminating particles into the controlled environment.

Cleanrooms are finding wider use in the manufacture, inspection and maintenance of precision products where it is essential that various operations be conducted in an environment as free of undesired small particles as possible. Cleanrooms can function effectively only when every effort is taken to maintain the close control necessary to preclude contamination of the controlled environment within the cleanroom. Such contamination most often is generated by the worker in the cleanroom and by items brought into the cleanroom. Rigorous standards have been established, and continue to be developed, for the operation of cleanrooms in such a manner as to exclude unwanted contaminants from the controlled environment. One potential source of particulate contamination in cleanrooms has been textile articles of manufacture, including cleanroom protective garments, such as smocks, hoods, boots, masks, gloves and the like, and wipers used extensively in connection with operations carried out in the controlled environment of a cleanroom. For example, in the fabrication of semiconductor wafers, wipers are used for cleaning up spills which can occur during the procedures carried out in the controlled environment of a cleanroom. In addition, wipers are used for wiping surfaces of various equipment and items in the cleanroom, as well as for wiping down the walls and other interior surfaces of the cleanroom itself. The very nature of a wiper, which requires a high degree of absorbency and pliability, militates against a construction which resists shedding and the concomitant release of small particles into the surrounding environment. Earlier efforts have been made to reduce the presence of deleterious particles in the cleanroom environment by assuring that the bulk of such deleterious particles either are removed from the wiper prior to introducing the wiper into the cleanroom environment or by capturing most of the potentially deleterious particles within the wiper in such a way that the particles will not be released into the controlled environment. Despite efforts to eliminate deleterious particles, some contamination still has been experienced and that contamination has been traced to the use of various textile articles, including wipers. Upon observation and analysis, it has been discovered that as various textile articles, including wipers, are used the filaments employed in the construction of the article tend to shed particles of the material of the filament itself so that regardless of the care taken to reduce or eliminate the presence of loose particles upon introduction of the article into the cleanroom environment, particles actually are generated during the course of use of the article, and particularly during the course of use of a wiper, as a result of shedding of particles of the material itself.

Since these observations tend to indicate that the use of textile articles, and especially wipers, in the controlled environment of a cleanroom inevitably will result in the introduction of some particles into the cleanroom environment, an object of the present invention is to assure that these particles, though present, are relatively benign; that is, any particles generated within a cleanroom environment as a result of the use of a textile article, and especially a wiper, in that controlled environment will be less likely to have a deleterious effect upon the process being carried out in the controlled environment. For example, in the manufacture of semiconductor wafers wherein the semiconductor wafers are exposed to high temperatures as a part of the manufacturing process, various particles can effect deleterious alterations in the configuration and operation of the semiconductor circuits, such as through the creation of short circuits or open circuits. In some instances, certain contaminating particles can act as spurious dopants causing deleterious alteration of the semiconductor function. In general, particles containing only organic matter are less likely to be harmful since the organic matter in such particles essentially will be burned away during the high temperatures experienced by the semiconductor wafer during such a manufacturing process. However, particles containing inorganic matter, such as metals and metal salts, usually will leave behind inorganic matter which will not necessarily be burned off and will tend to remain with the wafer and cause deleterious effects, as set forth above.

The preferred materials for textile articles, and especially wipers, in common use in connection with cleanroom operations are synthetic polymeric materials. One of the materials of choice for such articles, including wipers, is polyester. Filaments of polyester are woven or knit into fabrics in common use for the construction of wipers. One such construction is illustrated in U.S. Pat. No. 4,888,229. However, the process by which polyester itself is manufactured includes the use of a metallic catalyst, usually compounds of antimony or aluminum, in finite amounts (on the order of about 0.3 to 0.5 percent by weight). The metal catalyst therefore is present in the same proportion in the polyester filaments used in the construction of wipers. Particles shed from polyester wipers, then, will contain these metallic contaminants which can cause deleterious effects in the cleanroom environment. In addition to metallic constituents originating in the catalysts employed in making synthetic polymeric filaments, delusterants often are applied to alter the appearance of the completed product so as to render the product aesthetically more pleasing. These delusterants often include inorganic constituents, such as titanium dioxide, for example, the presence of which renders more deleterious any particles shed from wipers constructed of such materials, thereby contaminating an otherwise controlled cleanroom environment.

By constructing a textile article, and especially a wiper, for cleanroom use from a material which is essentially free of inorganic constituents, such as metallic constituents originating with a catalyst or with a delusterant, introduction into a cleanroom environment of certain deleterious particles, as set forth above, which otherwise might contaminate the controlled cleanroom environment is obviated. The present invention provides a textile article, such as a wiper, and a method by which certain contaminants previously introduced into a cleanroom environment by the use of such article, including wipers, in the cleanroom now are avoided so as to exclude and thereby control the entry of such contaminating particles into the cleanroom environment and reduce the deleterious effects of such contamination. Those particles which inevitably will be generated during use of the articles, such as wipers, are limited to relatively benign particles; that is, those particles which are less likely to cause deleterious effects in the process being carried out in the cleanroom, as discussed above. As such, the present invention attains several objects and advantages, some of which may be summarized as follows: Identifies a potential source of particulate contamination of a controlled environment, such as a cleanroom, and reduces the introduction of such particulate contamination through the use of textile articles, such as wipers, in the environment; provides a wiper structure and a method which reduces the introduction of unwanted, contaminating particles into a controlled environment, such as that found in a cleanroom, while enabling effective and efficient wiping procedures; enables the use of wiper materials having the desired pliability and absorbency characteristics in wipers employed in controlled environments, such as in cleanrooms, with reduced risk of introducing deleterious particulate contamination into the controlled environment; accounts for the fact that particulate matter inevitably will be released into a controlled environment, such as a cleanroom environment, during the course of use of a textile article, such as a wiper, in that environment by assuring that the released particulate matter is relatively benign; promotes ease of use as well as effectiveness in articles such as wipers constructed for use in a controlled environment, such as a cleanroom; utilizes commonly available materials, thereby enabling economy of manufacture and use while eliminating a source of particulate contamination, as set forth above; provides a strong and durable as well as an aesthetically pleasing textile article of manufacture, such as a wiper, which finds acceptance in a wide variety of manufacturing, inspection and maintenance procedures; and is readily manufactured economically in large numbers of consistent high quality.

The above objects and advantages, as well as further objects and advantages, are attained by the present invention, which may be described briefly as an article of manufacture, such as a wiper, especially suited for use in a controlled environment, such as a cleanroom environment, within which environment a process is carried out, the article being constructed of fibers of a synthetic polymeric material of the type including only constituents which are relatively benign in that the included constituents will be less likely to have a deleterious effect upon the process carried out in the controlled environment or upon the product of that process such as nylon bright. The present invention further includes an improvement in the method of controlling the entry of deleterious particles into a controlled environment, such as a cleanroom environment, in which an article of manufacture, such as a wiper, is used in connection with a process carried out in the controlled environment, the improvement including constructing the article of fibers of a synthetic polymeric material of the type including only constituents which are relatively benign in that the included constituents will be less likely to have a deleterious effect upon the process carried out in the controlled environment or upon the product of that process such as nylon bright.

In a preferred embodiment of the invention, an article in the form of a wiper is constructed from fibers of a synthetic polymeric material of the type which includes only relatively benign constituents; that is, constituents which are less likely to have a deleterious effect upon the process being carried out in the cleanroom, as set forth above. One such material which is available currently in commercial quantities is a nylon known as "nylon bright". Nylon bright is manufactured without the use of metallic catalysts and is supplied without added delusterants, such as titanium dioxide. Consequently, nylon bright includes only minute amounts of inorganic constituents, such as metal oxides and salts, which are considered deleterious contaminants in a cleanroom environment. For example, current commercially available nylon bright ordinarily includes no more than about 0.03 percent by weight of inorganic materials, which represents at least a full order of magnitude of reduction in inorganic materials, as compared to other synthetic polymeric materials, such as polyester, as set forth above. Such minute amounts of inorganic constituents are characterized herein as being essentially negligible. Thus, recognizing the fact that particulate materials inevitably will be generated by a wiper during use of the wiper in a cleanroom environment, the choice of a synthetic polymeric material such as nylon bright for the construction of the wiper assures that all particles generated during use of the wiper will be relatively benign in that the deleterious effects associated with the presence of inorganic constituents, such as metal oxides and salts, will be greatly reduced. Accordingly, a decided improvement is accomplished in the method of controlling the introduction of deleterious contaminating particles into the environment of a cleanroom, or a like controlled space.

The use of a synthetic polymeric material of the type described above enables the attainment of the advantages of ease of manufacture and dependable use afforded by synthetic polymeric materials, without the disadvantage of introducing unwanted contaminants into the cleanroom environment. The use of filaments of synthetic polymeric material enable the wiper to be constructed in the form of non-woven, woven or knitted materials.

It will be seen that the present invention attains several objects and advantages, some of which are: Identifies a potential source of particulate contamination of a controlled environment, such as a cleanroom, and reduces the introduction of such particulate contamination through the use of textile articles, such as wipers, in the environment; provides a wiper structure and a method which reduces the introduction of unwanted, contaminating particles into a controlled environment, such as that found in a cleanroom, while enabling effective and efficient wiping procedures; enables the use of wiper materials having the desired pliability and absorbency characteristics in wipers employed in controlled environments, such as in cleanrooms, with reduced risk of introducing deleterious particulate contamination into the controlled environment; accounts for the fact that particulate matter inevitably will be released into a controlled environment, such as a cleanroom environment, during the course of use of a textile article, such as a wiper, in that environment by assuring that the released particulate matter is relatively benign; promotes ease of use as well as effectiveness in wipers constructed for use in a controlled environment, such as a cleanroom; utilizes commonly available materials, thereby enabling economy of manufacture and use while eliminating a source of particulate contamination, as set forth above; provides a strong and durable as well as an aesthetically pleasing wiper which finds acceptance in a wide variety of manufacturing, inspection and maintenance procedures; and is readily manufactured economically in large numbers of consistent high quality.

It is to be understood that the above detailed description of preferred embodiments of the invention is provided by way of example only. Various details of design, construction and procedure may be modified without departing from the true spirit and scope of the invention as set forth in the appended claims.

We claim:

1. A wiper constructed to be used in a cleanroom environment or another similarly controlled environment, the wiper being constructed so as to consist essentially of fibers of nylon bright including no more than about 0.03 percent by weight of inorganic materials.

2. The invention of claim 1 wherein the article is constructed from a fabric material chosen from a woven material, a non-woven material or a knitted material, the fabric material including filaments of said synthetic polymeric material.

3. An improvement in the method of controlling the entry of deleterious particles into a cleanroom environment, or another similarly controlled environment, in which a wiper is used, the improvement including constructing the wiper so as to consist essentially of fibers of nylon bright including no more than about 0.03 percent by weight of inorganic materials.

* * * * *